US006354467B1

(12) United States Patent
Mabee

(10) Patent No.: US 6,354,467 B1
(45) Date of Patent: Mar. 12, 2002

(54) DEVICE FOR OPENING AND CLOSING A PACKAGE

(75) Inventor: Michael S. Mabee, Mason, OH (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/781,781

(22) Filed: Feb. 12, 2001

(51) Int. Cl.[7] ..... B67D 5/00

(52) U.S. Cl. ..... 222/83; 222/484; 222/461; 222/544; 222/556; 222/541.1; 222/542; 220/269; 229/125.14

(58) Field of Search ..... 222/83, 461, 484, 222/540, 541.1, 542, 544, 556, 557; 229/125.15, 125.14; 220/837, 269, 367, 266, 267, 268, 270, 271

(56) References Cited

U.S. PATENT DOCUMENTS 3,967,750 A * 7/1976 Cudzik ..... 220/266
4,059,201 A * 11/1977 Foster ..... 220/258
4,463,866 A * 8/1984 Mandel ..... 220/269
4,807,787 A * 2/1989 Langmeier et al. ..... 222/529
4,915,290 A 4/1990 Robichaud et al.
4,919,313 A * 4/1990 O'Brien ..... 222/541
4,925,034 A * 5/1990 Robichaud et al. ..... 206/603
4,930,683 A * 6/1990 Faber ..... 229/125.09
4,934,590 A * 6/1990 Robichaud et al. .... 229/125.09
4,988,012 A * 1/1991 Shastal ..... 220/258
5,101,999 A * 4/1992 Robichaud et al. ..... 220/258
5,364,019 A * 11/1994 Bjorck et al. ..... 229/125.09
5,547,316 A 8/1996 Zege et al.
5,655,678 A * 8/1997 Kobayashi ..... 220/269
5,806,757 A * 9/1998 Per et al. ..... 229/204
5,875,959 A * 3/1999 Weiteder et al. ..... 229/125.15
5,947,316 A 9/1999 Guillonnet
6,216,945 B1 * 4/2001 Gabrielli et al. ..... 229/204
6,257,449 B1 * 7/2001 Baerenwald ..... 222/83

* cited by examiner

*Primary Examiner*—Henry C. Yuen
*Assistant Examiner*—Frederick Nicolas
(74) *Attorney, Agent, or Firm*—Pitts & Brittian, P.C.

(57) ABSTRACT

An opening and closing device for a package containing a pourable product. The device is affixed to the package at the top end of the package and includes a ring affixed to the surface of the package. The ring encompasses an intended pouring opening which is prescored. A combination of a rupture element and a lever arm are hingedly mounted within the ring in position for activation of the rupture element through the lever arm, to rotate the distal end of the rupture element against the prescored region and to partly tear away a tab of the package. Further rotation of the rupture element carries the tab into the interior of the package. Provision is made for retention of the rupture element and tab within the interior of the package out of the flow path of contents being poured from the package through the opening formed by removal of the tab. A plurality of ribs disposed on that surface of the rupture element facing the package combine with the tab to define at least one air vent leading from the exterior to the interior of the package to facilitate uniform flow of the contents from the package. A lid is hinged to the ring for rotation into overlying relationship to the ring for reversible sealing relationship between the lid and the ring. A method for opening and closing a package is disclosed.

17 Claims, 3 Drawing Sheets

DEVICE FOR OPENING AND CLOSING A PACKAGE

TECHNICAL FIELD

The invention relates to a device intended to enable a package, particularly a package produced from paperboard or laminates containing paperboard, to be opened, have at least a portion of the contents poured therefrom, and thereafter closed. It also relates to the packages provided with such a device.

BACKGROUND OF THE INVENTION

Packages produced from paperboard or laminates containing paperboard, for liquid products have been extensively developed in recent years and are particularly tailored to the preservation and storage of food products, such as, for example, milk, fruit juices, etc. Packages of this type, which advantageously are of parallelepiped geometry, prove to be most particularly desirable whenever problems of transportation, storage and stacking arise.

However, the problem, on the one hand, of opening them and, on the other hand, of the possibility of closing them after a first use arose a very long time ago. Although solutions have been offered to the problem of successive opening and closing, the objective nevertheless has remained.

A device has been described, for example in U.S. Pat. No. 5,947,316, issued Sep. 7, 1999, for opening and closing a package of parallelepiped geometry made of paperboard. The device is secured within an opening region encompassing a defined pouring region for the product contained in the package. The pouring region is provided with prescoring to allow the package to be opened during the first use. The device includes a peripheral ring fastened to the package near the perimeter of the opening region, a lid to seal off the pouring region reversibly and being fixed to the peripheral ring, and a lever hinged by a hinge pin in the horizontal plane containing the device to rupture the pouring region along the prescoring. The lever has a first part intended first of all, by the lever effect, to break some of the prescoring to allow effective opening of the package, and then to be held in place inside the package thus opened, and a second part, constituting the lever arm acting on the first part, intended, after having acted cooperatively with the first part, to be folded back into its initial position to be parallel and in the plane containing the peripheral ring. Although somewhat effective as an opening and closing device, the design of the device tends to retard the pouring process. In particular, the flap defined by the torn prescoring is pushed back into the pouring opening as the contents are poured through the opening, effectively reducing the size of the opening and restricting the rate and consistency of flow through the opening. In addition, in this prior art device, a second opening must be defined as a vent hole at a location distant from the pouring opening to allow air to enter the package as the contents are poured out. In this device, the user must remember to take the second step of opening the vent hole or else may become frustrated with the slow and inconsistent pouring process because the liquid pours out relatively irregularly and causes splashes, given the ingress of air into the package in order to occupy the volume liberated by the liquid.

An object of the present invention is to provide an opening and closing device for packages, particularly packages substantially made of paperboard and more particularly packages of parallelepiped geometry, which is simple to employ, at a low manufacturing cost, is easy to affix to the package, and allows efficient pouring of the contents of the package.

SUMMARY OF THE INVENTION

The present device for opening and closing a package, such as a package of parallelepiped geometry, is intended to be affixed to the package within an opening region, having an inboard end and an outboard end, the outboard end being disposed adjacent a side of the package, and which incorporates therein a pouring region for the product contained in the package, the pouring region being provided with prescoring (cuts and/or scores) intended to allow the package to be opened during the first use. The prescoring includes an inboard end and an outboard end and the inboard end of the prescoring defines a fold line. The present device comprises: a peripheral ring, having an inboard end and an outboard end, affixed to the package within the perimeter of the opening region and encompassing the pouring region; a lid, intended by acting cooperatively with the peripheral ring to seal off the pouring region reversibly, the lid being hinged to the peripheral ring; and a lever, including a rupture element having an inboard end and an outboard end, hinged to the peripheral ring in a horizontal plane containing the device and intended, when it is actuated, to rupture the pouring region of the package at the prescoring, the hinge pin of the lever extending between opposite sides of the peripheral ring and lying opposite the pouring region.

The invention is characterized in that the lever comprises two parts, lying on opposite sides of the hinge pin: a rupture element, intended by the lever effect to break the prescoring which defines the pouring region, so as to allow effective opening of the package, and then to be held in place inside the package thus opened in a non-flow-obstructing position; and a second part, constituting a lever arm which acts cooperatively with the rupture element, intended, after having acted cooperatively with the rupture element, to be folded back into its initial position, i.e. so as to be generally parallel and in the plane containing the peripheral ring. The peripheral ring includes, adjacent the pouring region, lugs directed towards the inside of the ring and intended to act cooperatively with the rear face of the rupture element so as, after perforation of the prescoring, to hold the rupture element in place interiorly of the package approximately perpendicular to the plane of the pouring region to retain the ruptured tab of the pouring region apart from the opening and, simultaneously, define a vent for entering air during pouring.

In other words, the invention comprises fitting in the opening region of a package, particularly a package of parallelepiped geometry, a pouring and closing system making use of a lever to break the prescored regions made beforehand, in such a way as to define an efficient pouring region.

According to one aspect of the invention, the rupture element is connected, at one of its opposite ends, to the hinge pin by means of a flexible tab; the rear end of the rupture element acts cooperatively with the front face of the lever arm. Advantageously, the ring is provided with at least one projection directed inwardly of the ring and towards the pouring region, the projection being slightly tapered so as to facilitate movement of the rupture element therepast as the pouring region is pierced, and to thereafter resist reverse rotational movement of the rupture element from inside the package.

Further, in another aspect of the present invention, the distal (unhinged) end of the rupture element is provided with at least one, and preferably three, projections extending toward the pouring region and in position to engage the prescored pouring region upon rotational movement of the rupture element about its hinged end in a direction toward the pouring region. In a preferred embodiment, the central one of three projections is designed to initially engage the prescored pouring region, followed by engagement of the pouring region by flanking projections.

The invention also relates to the packages, particularly packages made of paperboard, provided with such opening, pouring, and closing devices.

The manner in which the invention may be realized and the advantages which stem therefrom will become clearer from the following illustrative embodiments given by way of non-limiting indication and supported by the appended figures.

DETAILED DESCRIPTION OF THE INVENTION

Figure 8:
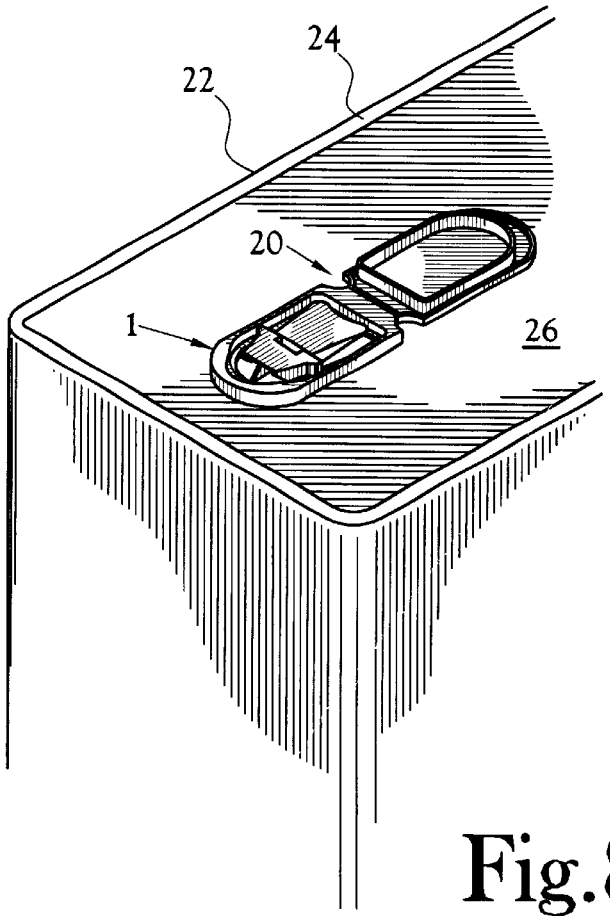
FIG. 8 is a representation of one embodiment of a package having an opening and closing device of the present invention affixed thereto.

Referring now to the Figures in which like reference numerals indicate like or corresponding features, there is illustrated in FIG. 8 an opening and closing device 20 intended to be fitted onto a package 22 which is substantially made of reputable paperboard, optionally aseptic, well-known per se, particularly of parallelepiped geometry with a substantially planar top end 24 and intended to contain a liquid, such as, for example, milk, fruit juice, etc.

On its top surface 26, for example, this package includes an opening region indicated generally by the numeral 1 to which is fastened the opening and closing device 20 according to the invention.

Referring to FIGS. 1–6 and 8, this opening region 1 includes therewithin a pouring opening 2 (FIG. 5), bounded and defined by prescoring 28 and/or a precut 30 produced, for example, using laser technology or conventional technology for making such cuts or scores. As used herein, the term "prescoring" is used to denote the existence of one or more precuts, scorings or combination thereof, which defines the perimeter of the pouring opening prior to initial rupture of the top surface 26 of the package. The opening and closing device according to the present invention basically comprises three elements. The first element defines a peripheral ring 5 affixed, as adhesive bonding or the like, to the top surface 26 of the package around the opening region 1.

Figure 1:
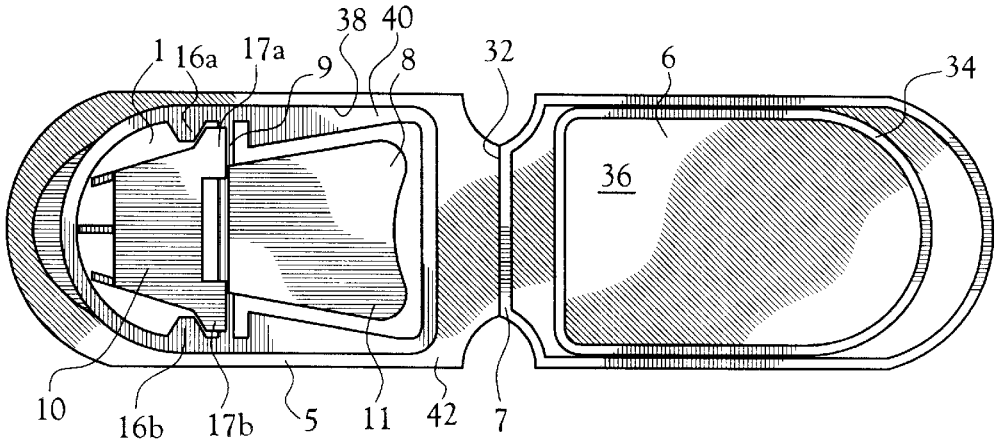
FIG. 1 is a diagrammatic representation, seen from above, of one embodiment of the present invention.
Figure 2:
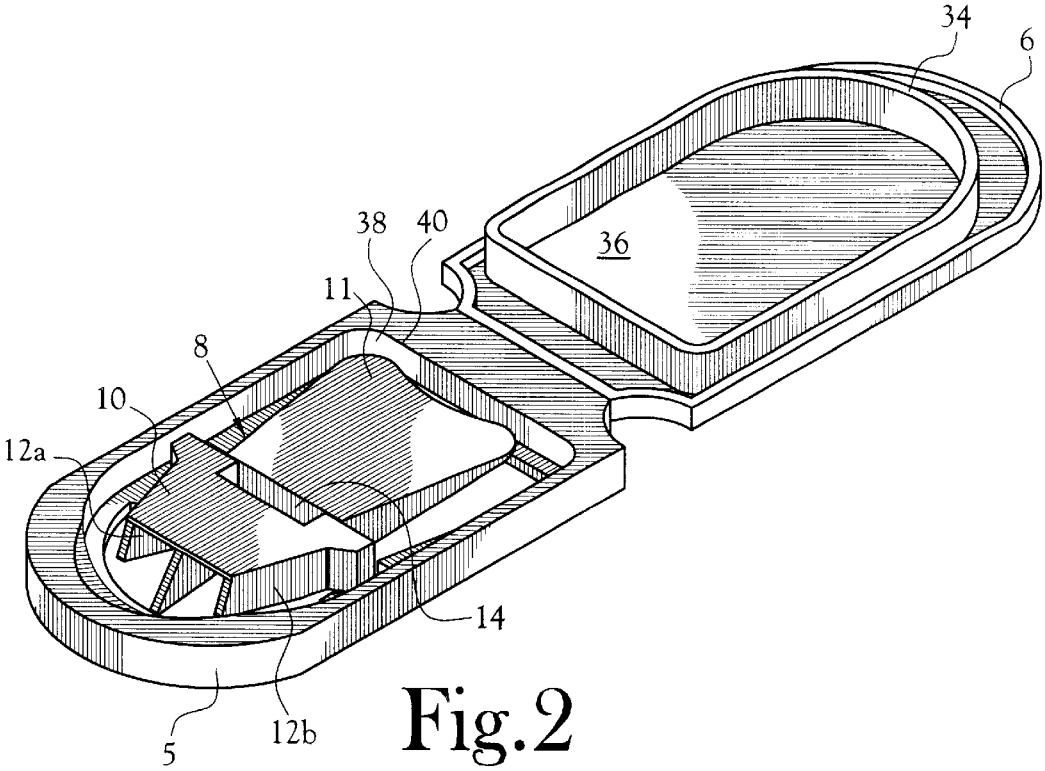
FIG. 2 is a perspective representation of one embodiment of the present invention.

The second element defines a lid 6 hinged to the end 32 of the ring 5 at a hinge 7, as may be seen in FIG. 1. The lid includes a wall 34 upstanding from the surface 36 of the lid, this wall being of a geometry suitable to be frictionally received within a matching opening 38 defined by the inner wall 40 of the peripheral ring 5 to provide a reversible closure of the pouring opening which is fluid tight, at the very least with respect to the liquid or product contained in the package.

The third element defines a lever 8 hinged to the ring 5, opposite the pouring opening 1, by means of a hinge pin 9. This lever includes two parts, namely: a distal rupture element 10, intended to enter the package, after having broken the prescoring 30 which delimits the pouring opening 2; and a rear lever arm 11, substantially independent of the rupture element 10, intended first of all to pivot upwardly from an initial position (FIG. 2) substantially within the plane of the top surface 26 of the package, towards the pouring opening 2 of the package while acting cooperatively with the rupture element to create a lever effect which results in rotation of the rupture element 10 and resulting rupture of the prescoring defining the pouring opening 2, and then in turn to be folded back into the rear end 42, and generally into the plane of the peripheral ring 5.

The rupture element 10, which may be of any one of various geometries when viewed in the top view thereof, e.g., substantially semicircular, triangular or trapezoidal is connected to the hinge pin 9 in the depicted embodiment by means of two flexible tabs 17*a* and 17*b* and includes two side ribs 12*a* and 12*b* which project from the lower surface 44 of the rupture element and in position to engage the top surface 26 of the package upon rotation of the rupture element about the hinge pin 9. The heights of the depicted side ribs 12*a* and 12*b* increase from a minimum height at the distal ends 46, 48 thereof to a maximum height at their proximal ends 50, 52 respectively. The ends 13*a* and 13*b* of the ribs 12*a* and 12*b* of the rupture element act cooperatively with the front face 14 of the lever arm 11 during the phase of opening the pouring opening.

Figure 5:
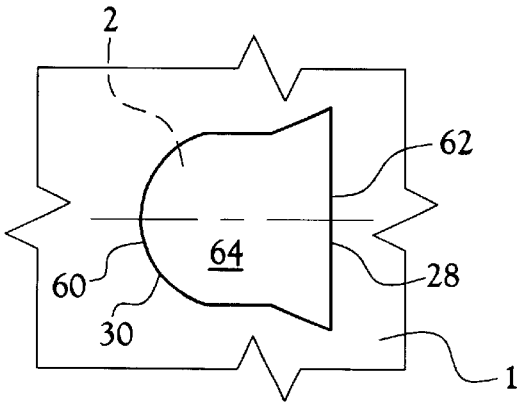
FIG. 5 is a representation, in plan view, of one embodiment of a prescored and/or precut region of a pouring region adapted for use with the present invention.
Figure 6:
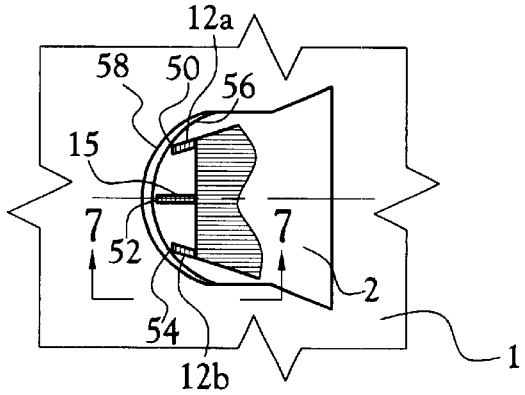
FIG. 6 is a top view of a portion of the device depicted in FIG. 1.
Figure 7:
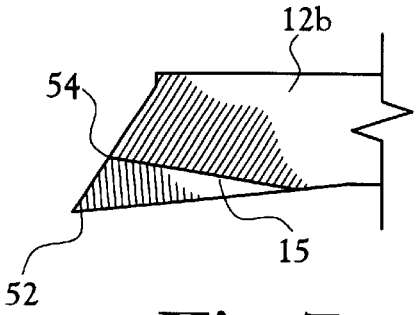
FIG. 7 is a side view of a portion of the device depicted in FIG. 6 and taken generally along the line 7—7 of FIG. 6.

To facilitate this opening phase, the distal end of the rupture element 10 includes a third rib 15 located generally parallel to, between and spaced apart from, the side ribs 12*a* and 12*b* and is intended to be moved into engagement with the prescored region of the package ahead of the engagement of the distal ends of the ribs 12*a* and 12*b* with the prescored region. Referring to FIGS. 5 and 6, in one embodiment of the rupture element 10, when viewed from the top, the distal tips 50, 52, 54 of the three ribs 12*a*, 12*b*, and 15 respectively, define a curve 56 which is generally concentric with a curved precut 58, which defines the outward end 60 of the prescoring of the pouring region. This curve 56 defined by the distal tips of the ribs preferably is disposed contiguous to the curved precut 58. Upon rotation of the rupture element 10 about the hinge pin 9, the most outboard tip 52 of the distal end of the central rib 15 initially engages the package surface within the prescoring at a location immediately adjacent the midpoint of the curved precut 58. At this time, essentially all of the energy imparted to the rupture element 10 to rotate it is applied to the package surface through the means of the outboard tip 52 of the distal end of the rib 15. This concentration of energy readily produces an initial rupture of the package material adjacent the midpoint of the curved precut 58. The present inventor has found that initial rupture of the package material is readily accomplished employing a substantially lesser force applied to the rupture element by the lifting of the lever arm 11 to rotate the rupture element, than has been heretofore required of the prior art "lever action" package opening devices. Moreover, this ease of opening has been found to minimize splash of the contents out of the package in the course of opening the package. In addition to the advantage associated with the initial rupture of the pouring region of the package by the present device, as the rupture element is further rotated inwardly toward the inside of the package, the outboard tips 50 and 54 of the side ribs 12*a* and 12*b* engage the package material on opposite sides of the central rib 15 along the prescoring, thereby effecting a uniform and full tearing away of the package material in the pouring region, except for the most inward side edge 62 of the prescored region. This inward side edge preferably is scored 28 for ready bending without being torn away from the package material. Thus, as the prescored region of the pouring opening is torn away from the package material by further rotation of the rupture element inwardly of the package, there is formed a tab 64 of package material which is pushed inwardly of the package and which remains secured to the package material by its side edge 62 remaining attached to the package material. In the embodiment depicted in FIGS. 3 and 4, it will be noted that the rupture element, hence any tab which has been torn from the package material ultimately assumes an orientation which is substantially perpendicular to the top surface of the package.

Figure 3:
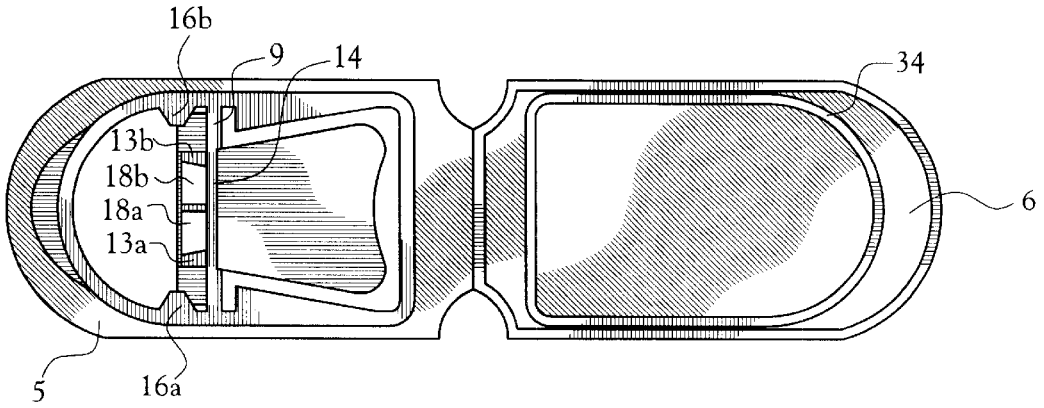
FIG. 3 is a diagrammatic representation, seen from above, of the embodiment of the present invention, after opening of the package, depicted in FIG. 1.
Figure 4:
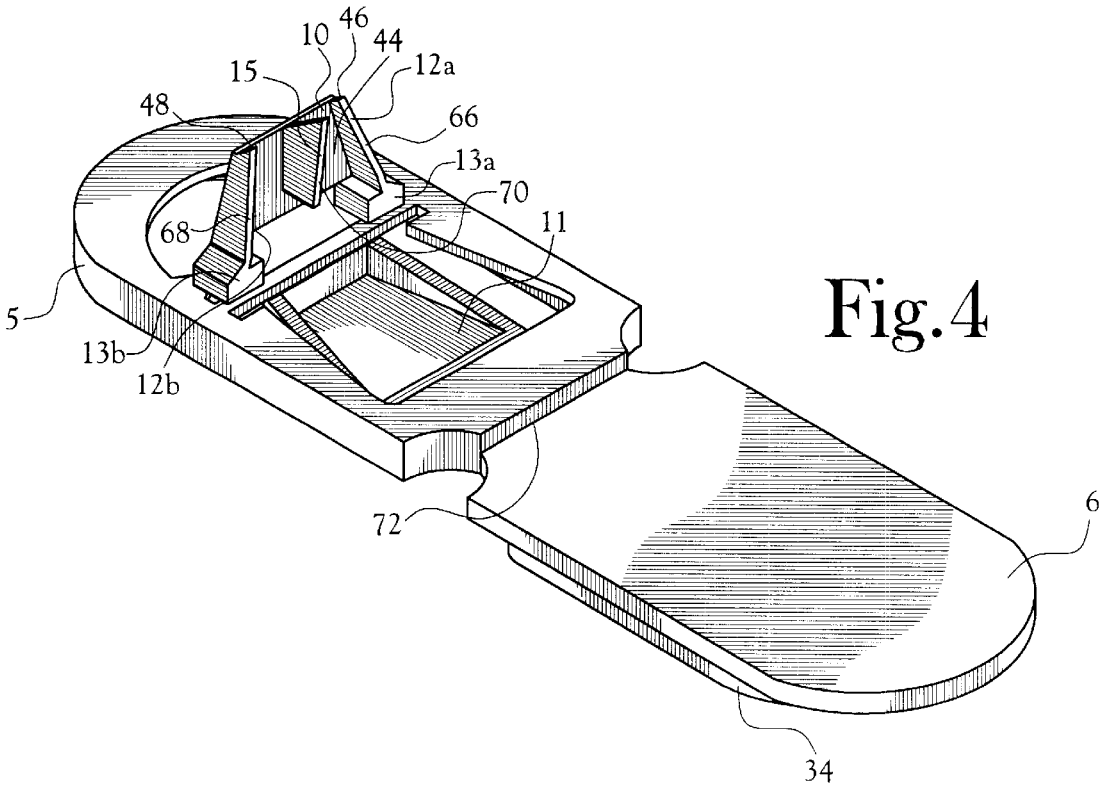
FIG. 4 is a perspective view, seen from below, of one embodiment of the present invention after it has opened a package.

It will be further noted from FIGS. 3 and 4, that once the rupture element has been fully depressed into the interior of the package, only the outer linear surfaces 66, 68 and 70 of the ribs 12*a*, 12*b*, and 15 are in contact with the surface of the tab so that there are defined at least one, and preferably two, open passageways 18*a* and 18*b* between the surface of the tab and the rupture element, such passageways leading from the exterior into the interior of the package at locations whereby air may enter the package as the contents of the package are being poured out of the package through the pouring region.

In the embodiment depicted, ribs 12*a*, 12*b* and 15 project downwardly towards the pouring region, the projections being slightly tapered to define penetrating distal tips 50, 52 and 54 make it even easier to rupture the prescoring which defines the pouring region.

The peripheral ring 5 is provided with two opposed flexible lugs 16*a* and 16*b* directed towards the center of the ring. As the rupture element 10 is pushed into the package, the lugs 16*a* and 16*b* flex out of the way to permit passage of the rupture element past the lugs 16*a* and 16*b*. Thereafter, the lugs flex back to their rest positions, retaining the rupture element 10 in a position within the package when the lever arm 11 is returned to its original position generally parallel and lying flat adjacent the top surface 26 of the package. Because of the engagement of the ribs of the rupture element with the tab, the tab which has been torn from the packaging material is also held in its open position interiorly of the package when the rupture element 10 is restrained within the package by the lugs 16*a*, 16*b* and prevented from moving back to its original position in the peripheral ring 5, especially as liquid is being poured through the pouring opening.

As already mentioned, the second part 11 fulfills the function of a lever arm, which acts cooperatively with the rupture element 10 to bring about the opening of the pouring opening 2. It is hinged at its front end 14 to the hinge pin 9.

Advantageously, the opening and closing device of the present invention is readily molded from a thermoplastic material, for example, and therefore constitutes a one-piece component.

The simplicity of use and of operation of this device may therefore be recognized, since the rupture element restrains the partly torn away tab from restricting the effective size of the pouring opening defined in the prescored region, and defines at least one vent for the entry of air into the package, thus making it easier for the liquid to flow out of the package in a uniform flow stream.

Following partial removal of the contents of a package fitted with the present device, as desired, the pouring opening may be closed to further flow therethrough by rotating the lid 6 about its hinged end 72 into releaseable sealing engagement of the internal wall 3 of the lid with the upstanding wall 34 encircling the pouring region of the package.

This opening and closing device therefore proves to be particularly advantageous within the framework of the aseptic preservation of the contents of the package for which it is intended. Moreover, because of its simplicity of implementation and the construction of the components of which it is composed, in particular molded plastic components, it has a low cost. Finally, because of the one-piece character of the present opening and closing device, the manufacturing cost of the final package may be optimized.

While a preferred embodiment has been shown and described, it will be understood that it is not intended to limit the disclosure, but rather is intended to cover all modifications and alternate methods and apparatus within the spirit and scope of the invention as defined in the appended claims.

What is claimed:

1. An opening and closing device for a package having a top end including a substantially flat surface area comprising a peripheral ring affixed to the substantially flat surface area of the package and defining an opening region having an inboard end and an outboard end, said outboard end being disposed adjacent a side of the package, prescoring located within said opening region, said prescoring having an inboard end and an outboard end and defining a pouring region from which the contents of the package may be poured, said inboard end of said prescoring defining a fold line, a hinge pin extending between opposite sides of said ring at a location adjacent said inboard end of said ring, a rupture element having an inboard end, said inboard end being hingedly mounted to said hinge pin for rotational movement of said rupture element between a first position outside the package and a second position inside said package, and having a distal end adapted to rupture at least a portion of said prescoring and develop a pouring opening in the top end of the package within the opening region, said rupture element including a bottom surface disposed in facing relationship to the top surface of the package prior to rotational movement of said rupture element into engagement with the top surface of the package, at least two ribs disposed on said bottom surface of said rupture element and projecting generally perpendicularly therefrom in position to engage the top surface of the package within the prescoring upon rotation of the rupture element about said hinge pin and toward the top surface of the package and effect rupture of at least a portion of said prescoring at the outboard end thereof to develop a partly torn away tab of the top end of the package, said tab being carried inwardly of the package upon rotation of the distal end of the rupture element inwardly of the package, said ribs being spaced apart from one another and defining an open passageway therebetween, said passageway being further bounded by said partly torn away tab of the top end of the package which is in engagement with said ribs.

2. The opening and closing device of claim 1 and including a further rib disposed on said bottom surface of said rupture element and substantially centrally between said first and second ribs, said further rib including a distal tip which extends beyond the distal end of said rupture element to a location contiguous the outboard end of the prescoring.

3. The opening and closing device of claim 1 wherein said prescoring defines a pouring opening having a curved outboard end.

4. The opening and closing device of claim 1 including a lever arm having distal end and a proximal end, said proximal end being hingedly connected to said hinge pin for rotational movement of said lever arm about said hinge pin, said inboard end of said rupture element and said proximal end of said lever arm being disposed adjacent one another whereby rotation of said lever arm effects engagement of said adjacent ends of said rupture element and said lever arm and rotational movement of said rupture element as a function of the rotational movement of said lever arm.

5. The opening and closing device of claim 1 and including a lid hingedly mounted to said inboard end of said ring, said lid including a marginal wall adapted to sealingly engage said ring to reversibly close said pouring opening.

6. A package formed of a reputable material and including an opening and closing device as set forth in claim 1.

7. The opening and closing device of claim 2 wherein each of said first, second and further ribs includes a distal tip which extends beyond the distal end of said rupture element to a location contiguous to the outboard end of the prescoring.

8. The opening and closing device of claim 4 wherein said rotational movement of said lever arm is sufficient to rotate said rupture element to its second position inside the package.

9. A package in accordance with claim 6 and including a lid hingedly mounted to said inboard end of said ring, said lid including a marginal wall adapted to sealingly engage said ring to reversibly close said pouring opening.

10. A package in accordance with claim 6 and including a further rib disposed on said bottom surface of said rupture element and substantially centrally between said first and second ribs, said further rib including a distal tip which extends beyond the distal end of said rupture element to a location contiguous the outboard end of the prescoring.

11. The opening and closing device of claim 7 wherein said distal tips of said first, second and further ribs define an imaginary curve which is of substantially the same curvature as the curvature of said curved outboard end of said prescoring, said imaginary curve defined by said ribs being displaced inwardly of the prescoring and contiguous to said curved outboard end of said prescoring.

12. The opening and closing device of claim 8 wherein said rupture element is oriented substantially perpendicular to the top surface of the package when in its second position.

13. The opening and closing device of claim 8 including at least one lug disposed on said ring and projecting inwardly of said ring to restrict rotation of said rupture element away from its second position.

14. A package in accordance with claim 9 and including a lever arm having distal end and a proximal end, said proximal end being hingedly connected to said hinge pin for rotational movement of said lever arm about said hinge pin, said inboard end of said rupture element and said proximal end of said lever arm being disposed adjacent one another whereby rotation of said lever arm effects engagement of said adjacent ends of said rupture element and said lever arm and rotational movement of said rupture element as a function of the rotational movement of said lever arm.

15. A method of forming an opening in a package formed of a packaging material comprising the steps of prescoring a profile of a desired opening to be made in the top end of the package, said prescoring including an outboard end and an inboard end, employing a rupture element having a plurality of spaced apart ribs on a surface thereof facing the package, rupturing substantially all of said prescoring other than that portion of the prescoring at said inboard end thereof to define a tab of packaging material having a geometry substantially like the profile defined by the prescoring and forming an opening through the packaging material of the package, forcing said rupture element, hence said tab, inwardly of said package to a position wherein said tab is out of the desired flow path of the contents from the package, defining a passageway between said ribs of said rupture element and said tab leading from the interior of the package to the exterior of the package for the inflow of air to the package in the course of pouring of the contents from the package.

16. The method of claim 15 and including the step of maintaining said rupture element in engagement with said tab to thereby maintain said tab in said position out of the desired flow path of the contents from the package.

17. The method of claim 15 and including the steps of providing a lid hingedly attached to said ring in position to be rotated into reversible sealing relationship said ring to thereby close said pouring opening.

* * * * *